US011584623B2

(12) United States Patent
Schoonmaker

(10) Patent No.: US 11,584,623 B2
(45) Date of Patent: Feb. 21, 2023

(54) ELECTRIC ACTUATION ASSEMBLY FOR CRANE PINNED BOOM

(71) Applicant: Manitowoc Crane Companies, LLC, Milwaukee, WI (US)

(72) Inventor: Stephen J. Schoonmaker, Chambersburg, PA (US)

(73) Assignee: Manitowoc Crane Companies, LLC, Milwaukee, WI (US)

( * ) Notice: Subject to any disclaimer, the term of this patent is extended or adjusted under 35 U.S.C. 154(b) by 83 days.

(21) Appl. No.: 16/910,422

(22) Filed: Jun. 24, 2020

(65) Prior Publication Data

US 2020/0399100 A1 Dec. 24, 2020

Related U.S. Application Data

(60) Provisional application No. 62/880,473, filed on Jul. 30, 2019, provisional application No. 62/865,724, filed on Jun. 24, 2019.

(51) Int. Cl.
*B66C 23/70* (2006.01)

(52) U.S. Cl.
CPC ..... *B66C 23/708* (2013.01); *B66C 23/705* (2013.01); *B66C 23/707* (2013.01); *B66C 2700/0378* (2013.01)

(58) Field of Classification Search
None
See application file for complete search history.

(56) References Cited

U.S. PATENT DOCUMENTS 5,628,416 A 5/1997 Frommelt et al.
2015/0041422 A1* 2/2015 Kaupert ..... B66C 23/708 212/292
2015/0128735 A1 5/2015 Klein et al.
2019/0367338 A1* 12/2019 Schoonmaker ..... B66C 23/705
2022/0242703 A1* 8/2022 Schoonmaker ..... B66C 23/708

FOREIGN PATENT DOCUMENTS

CN 105179374 12/2015
DE 10223449 A1 12/2003

OTHER PUBLICATIONS

Extended European Search Report issued in Application No. 20181443.1 dated Nov. 23, 2020, (8 pages).
WPI Database Clarivate Analytics, 2017. (1 page).

* cited by examiner

*Primary Examiner* — Sang K Kim
*Assistant Examiner* — Nathaniel L Adams
(74) *Attorney, Agent, or Firm* — Cook Alex Ltd.

(57) ABSTRACT

A pin actuator assembly for a telescoping boom includes a locking head having a base, an operating plate operably coupled to the base, one or more cylinder pins and/or one or more section lock arms movable in response to movement of the operating plate relative to the base. The pin actuator assembly also includes an actuator operably coupled to the operating plate and configured to move the operating plate relative to the base. The actuator includes an electric motor and a drive arm. The electric motor is configured to drive the drive arm between an extended drive arm position and a retracted drive arm position. The pin actuator assembly further includes a motion mitigator having a housing, a rod movable relative to the housing and operably coupled to the actuator, a first biasing member coupled between the rod and the housing and a second biasing member coupled between the rod and the housing.

11 Claims, 10 Drawing Sheets

ELECTRIC ACTUATION ASSEMBLY FOR CRANE PINNED BOOM

BACKGROUND

The following description relates generally to a telescoping boom of a crane, the telescoping boom having a pin actuator assembly for actuating at least one pin of a locking head.

A crane having a telescoping boom includes a mechanical locking head having cylinder pins and section pins configured for selective engagement with and disengagement from portions of a telescoping section of the boom. The mechanical locking head is mounted on a linear boom actuator configured to extend and retract individual telescoping sections of the boom. To this end, the cylinder pins are configured to engage a telescoping section to drive the telescoping section to extend or retract with movement of the linear boom actuator. Conversely, the cylinder pins may disengage the telescoping section to allow for movement of the linear boom actuator and the mechanical locking head relative to the boom sections. Accordingly, the mechanical locking head may be repositioned to engage a different telescoping section to extend or retract the different telescoping section.

The section pins of the mechanical locking head are configured to engage a section lock on a telescoping section of the boom. The section pins are operable to move the section lock between a locked position, where telescoping movement of the telescoping boom section relative to an adjacent boom section is restricted, and an unlocked position, where telescoping movement of the telescoping boom section relative to an adjacent boom section is permitted. Thus, with the cylinder pins engaged in a telescoping section, and the section lock moved to an unlocked position, the linear boom actuator may drive movement of the telescoping section to extend or retract. Upon reaching a desired position, the section pins of the mechanical locking head can be operated to actuate the section lock and substantially prevent telescoping movement of the telescoping section relative to an adjacent boom section and the cylinder pins may be disengaged from the telescoping section. The mechanical locking head may then be repositioned.

A known linear boom actuator is formed as a telescoping rod-cylinder assembly. The cylinder pins and the section pins of the mechanical locking head are hydraulically actuated by way of a hydraulic trombone cylinder within the rod of the telescoping rod-cylinder linear boom actuator. However, operation of the hydraulic trombone cylinder to actuate the pins may be adversely affected by entrained air and/or cold temperatures. Moreover, pressure within the trombone cylinder may deflect the rod or cylinder of the linear boom actuator during an un-pinning operation, which may cause the pins to become stuck. This results in delayed or extended boom pinning operations to free the stuck pins.

US Pat. Appl. Pub. No. 2015/0128735 discloses a drive of a sliding connecting member of a locking system of a telescoping system having an outer telescopic section and an inner telescoping section each provided with a locking hole into which a locking bolt can be entered and withdrawn via the sliding connecting member. The locking bolt is moveable by an engagement member running in the sliding path in such a way that the locking bolt effects a linear movement and the boom sections can be connected to one another by insertion of the locking bolt into the bolting hole and the sliding connecting member can be driven by a linear electric drive.

However, even in the known system incorporating an electric actuator, cylinder and/or section pins may be positioned such that free motion of the pins is impeded. A control system may operate the linear boom actuator and/or the electric actuator such that the pins are moved as desired when a position is reached where the pins may be freely moved. However, such an approach may be unreliable, and leaves uncertainty in the operations of the pins. For example, repeated attempts by the control system to operate the electric actuator when the movement of pins is impeded may result in damage or premature wear to the electric actuator.

It is therefore desirable to provide pin actuator assembly for a telescoping boom which incorporates a motion mitigator to take up movements of an electric actuator when movement of cylinder and/or section pins of a locking head is impeded.

SUMMARY

According to one aspect, a pin actuator assembly for a telescoping boom includes a locking head having a base, an operating plate operably coupled to the base, and one or more cylinder pins and/or one or more section lock arms movable in response to movement of the operating plate relative to the base. The pin actuator assembly also includes an actuator operably coupled to the operating plate and configured to move the operating plate relative to the base, the actuator having an electric motor and a drive arm. The electric motor is configured to drive the drive arm between an extended drive arm position and a retracted drive arm position. The pin actuator assembly further includes a motion mitigator having a housing, a rod movable relative to the housing and operably coupled to the actuator, a first biasing member coupled between the rod and the housing and a second biasing member coupled between the rod and the housing.

According to another aspect, a telescoping boom for a crane includes a base section, a plurality of telescoping sections movable relative to the base section to adjust a length of the boom, a boom actuator disposed within the base section operable to move a telescoping section of the plurality of telescoping sections to adjust the length of the boom, and a pin actuator assembly operably connected to the boom actuator. The pin actuator assembly includes a locking head comprising a base, an operating plate operably coupled to the base, and one or more cylinder pins and/or one or more section lock arms movable in response to movement of the operating plate relative to the base. The pin actuator assembly also includes a pin actuator operably coupled to the operating plate and configured to move the operating plate relative to the base, the pin actuator having an electric motor and a drive arm. The electric motor is configured to drive the drive arm between an extended drive arm position and a retracted drive arm position. The pin actuator assembly further includes a motion mitigator having a housing, a rod movable relative to the housing and operably coupled to the actuator, a first biasing member coupled between the rod and the housing and a second biasing member coupled between the rod and the housing.

These and other features and advantages of the present invention will be apparent from the following detailed description, in conjunction with the appended claims.

DETAILED DESCRIPTION

Figure 1:
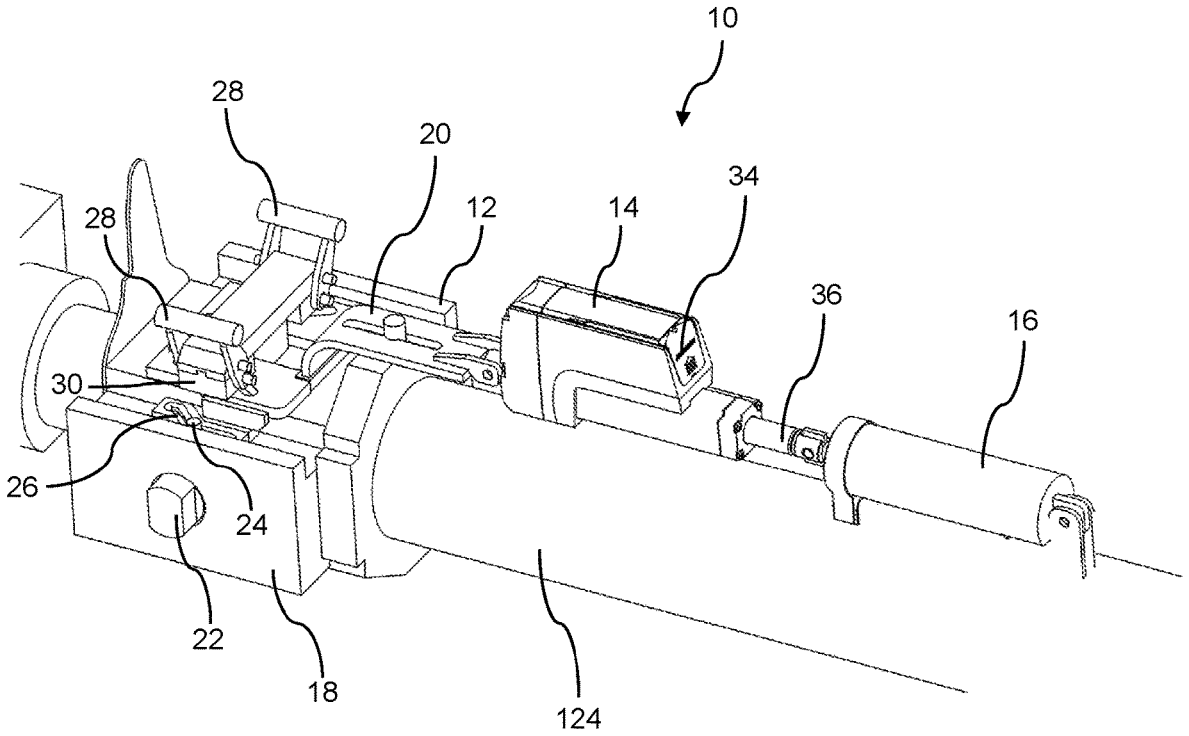
FIG. 1 is a perspective view of a pin actuator assembly in a first condition according to an embodiment.

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

The present disclosure relates generally to a pin actuator assembly for a boom actuator in a telescoping boom of the type found, for example, on a crane. The pin actuator assembly generally includes a locking head, an electric actuator and a motion mitigator.

The locking head includes a base and an operating plate movable relative to the base along or parallel to a longitudinal axis of the boom actuator and/or telescoping boom. The operating plate is operably connected to one or more cylinder pins and/or one or more section lock arms, such that movement of the operating plate causes movement of the one or more cylinder pins and/or the one or more section lock arms. For example, the operating plate may include a first guide wall interfacing with a cylinder pin linkage interconnected between the first guide wall and the cylinder pin and/or a second guide wall interfacing with a section lock arm linkage interconnected between the second guide wall and the section lock arm.

In one example, the first guide wall includes a first section which does not cause movement of the cylinder pin in response to relative movement of the operating plate, and a second section which causes movement of the cylinder pin in response to relative movement of the operating plate. Similarly, the second guide wall includes a first section which does not cause movement of the section lock arm in response to relative movement of the operating plate, and a second section which causes movement of the section lock arm in response to relative movement of the operating plate. In one embodiment, the first section of each guide wall may extend generally in a direction of movement of operating plate, for example, parallel to the longitudinal axis. The second section may extend in a direction having a longitudinal component and a lateral component such that the second section is angled relative to the first section for each guide wall. In one embodiment, the cylinder pin linkage is engaged with the first section of the first guide wall while the section pin arm linkage is engaged with the second section of the second guide wall. Conversely, in one embodiment, the cylinder pin linkage is engaged with the second section of the first guide wall while the section pin arm linkage is engaged with the first section of the second guide wall. Thus, in one embodiment, the movement of the operating plate may provide movement of a cylinder pin or section lock arm, while the other of the cylinder pin and section lock arm is held in position.

The electric actuator is operably connected to the operating plate. A drive arm of the electric actuator may be extended or retracted to drive corresponding movement of the operating plate relative to the base during normal operation of the pin actuator assembly. In some instances, however, movement of the one or more cylinder pins and/or the one or more section lock arms may be inhibited or impeded, which consequently inhibits or impedes the intended movement of the operating plate in response to movement of the drive arm.

The motion mitigator is operably connected to the electric actuator and the operating plate. The motion mitigator is configured to operate in a substantially rigid condition when the one or more cylinder pins and/or the one or more section lock arms are free to move in the intended manner. However, in the event movement of the one or more cylinder pins and/or movement of the one or more section lock arms is inhibited, thereby preventing intended movement of the operating plate, the motion mitigator is configured to be placed into one or more loaded conditions by taking up, or mitigating, movement of the drive arm. For example, when movement of the operating plate is inhibited, the drive arm may still extend or retract as intended. However, the movement of the drive arm is absorbed by the motion mitigator instead of causing movement of the operating plate.

In some embodiments, the motion mitigator includes a rod disposed within a housing and one or more springs interconnected between the rod and housing. In a rigid configuration, i.e., during normal operation of the pin actuator assembly, the rod remains substantially fixed relative to the housing. However, in the event movement of operating plate is inhibited, movement of the drive arm causes the rod to move relative to housing, or vice versa, placing the rod in a retracted position or an extended position relative to the housing, thereby compressing a spring and placing the motion mitigator in a loaded condition.

In a loaded condition, the motion mitigator applies a preload to the operating plate. When the movement of the operating plate is no longer inhibited, the preload applied from the motion mitigator causes the operating plate to move, thereby completing the intended movements in response to operation of the electric actuator. Accordingly, the intended movement of the one or more cylinder pins and/or the one or more section lock arms may be completed without further movement of the drive arm or operation of the electric actuator.

Referring to FIG. 1, a pin actuator assembly 10 for a telescoping boom of a crane, according to embodiments described herein, generally includes a locking head 12, an actuator 14 and a motion mitigator 16. In one embodiment, the locking head 12 includes a base 18, an operating plate 20 operably coupled to the base 18, one or more cylinder pins 22 and/or one or more section lock arms 28 movable in response to movement of the operating plate 20 relative to the base 18.

The cylinder pin 22 is movable between an extended position and a retracted position. Although the figures depict a single cylinder pin 22, those having skill in the art will appreciate that a second cylinder pin (not shown) may be positioned at an opposite side of the locking head 12 and may operate in a substantially mirrored fashion to the cylinder pin 22. Accordingly, it will be appreciated that references to a single cylinder pin in the following description may apply equally to a pair of cylinder pins 22.

In one embodiment, the cylinder pin 22 may be operably coupled to the operating plate 20 by a cylinder pin linkage 24 engaged with a first guide wall 26 of the operating plate 20. The first guide wall 26 may be shaped such that movement of the operating plate 20 causes the first linkage 24 to move in a direction substantially transverse to a direction of movement of the operating plate 20 between the extended and retracted pin positions. The first guide wall 26 may be, for example, a wall formed in a slot or groove, or a wall projecting from a surface of the operating plate 20. Movement of the operating plate 20 may cause the first guide wall to apply a force to the cylinder pin linkage 24 which is transmitted to the cylinder pin 22, thereby causing movement of the cylinder pin. The cylinder pin linkage 24 may include, for example, a lug extending to engage the first guide wall 26.

Figure 2:
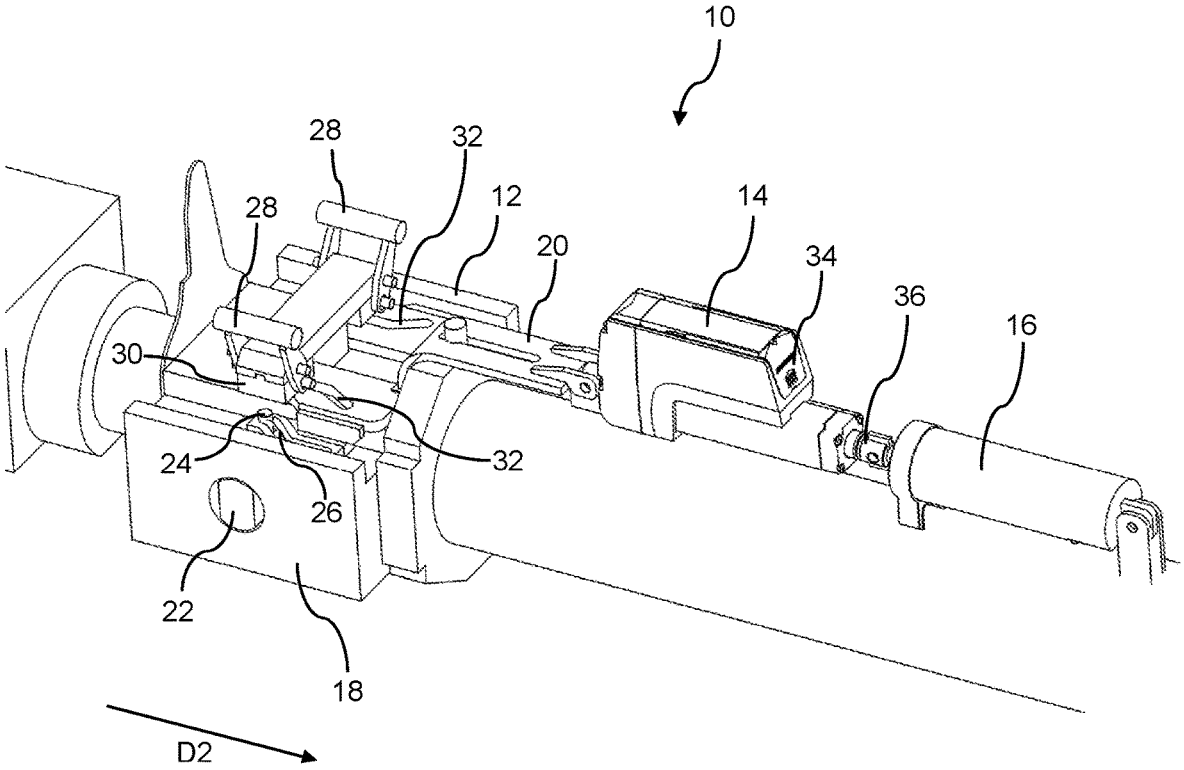
FIG. 2 is a perspective view of a pin actuator assembly in a second condition, according to an embodiment.
Figure 3:
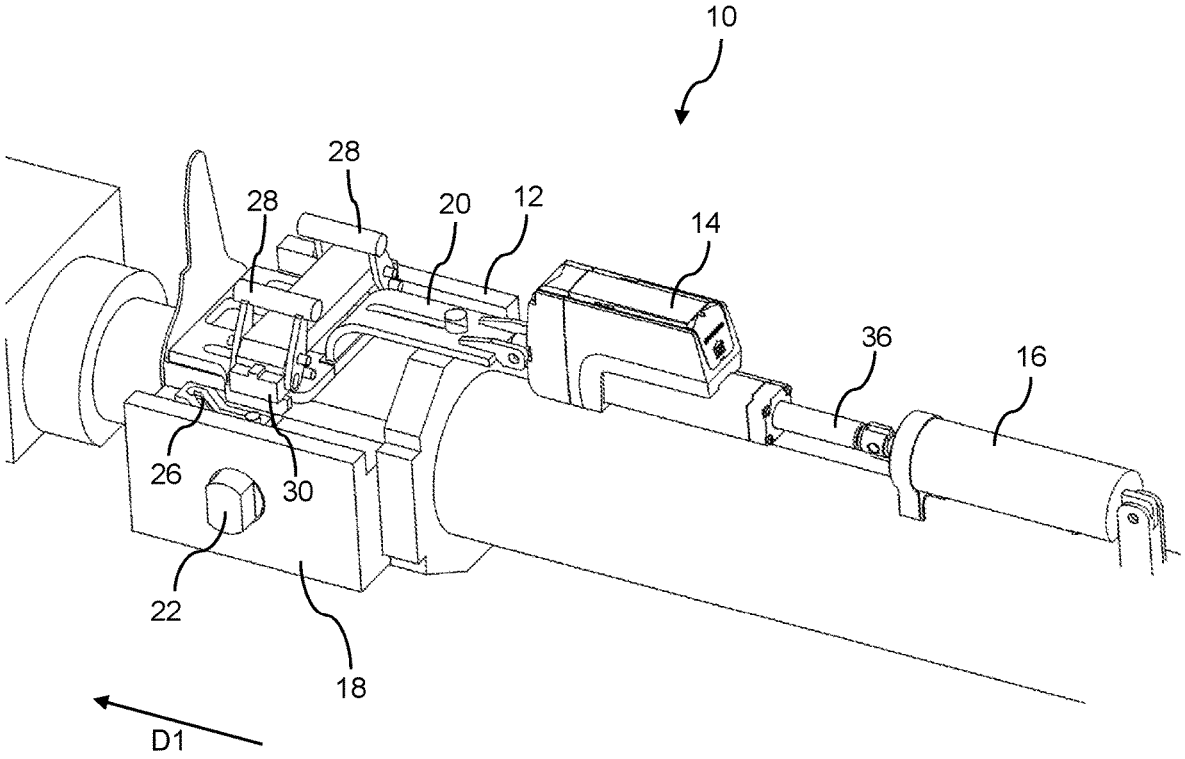
FIG. 3 is a perspective view of a pin actuator assembly in a third condition, according to an embodiment.

The one or more section lock arms 28 are configured to move between a locking position (FIG. 1) and an unlocking position (FIG. 3). In one embodiment, a section lock arm 28 may be operably coupled to the operating plate 20 by a section lock arm linkage 30 engaged with a second guide wall 32 (FIG. 2) of the operating plate 20. The second guide wall 32 may be shaped such that movement of the operating plate 20 causes the section lock arm linkage 30 to move in a direction substantially transverse to the direction of the movement of the operating plate 20. This transverse movement of the section lock arm linkage 30 may cause the section lock arm 28 to move, for example by rotating or pivoting, between the locking and unlocking positions, as described further below.

A second section lock arm 28 may be moved between the locking and unlocking positions with a separate section lock arm linkage 30 and second guide wall 32 similar to those described above. In one embodiment, one or more section lock arms 28 are operably coupled to respective section locking pins (not shown) disposed on a telescoping boom section, such that movement of the one or more section lock arms 28 is configured to move the section locking pin(s) to lock or unlock a telescoping boom section to or from an adjacent telescoping boom section. For example, in one embodiment, movement of the section lock arms 28 from the locking position to the unlocking position is configured to retract corresponding section locking pins to unlock the telescoping boom section from an adjacent telescoping boom section.

Referring still to FIG. 1, the actuator 14 includes a motor 34 and a drive arm 36. In one embodiment, the motor is an electric motor 34, and is operable to extend and retract the drive arm 36. In one embodiment, the actuator 14 is coupled to the operating plate 20 such that movement of the drive arm 36 may drive movement of the operating plate 20 relative to the base 18.

The motion mitigator 16 is operably coupled to the actuator 14. In one embodiment, the motion mitigator 16 is coupled to the drive arm 36 such that the actuator 14 is disposed between the operating plate 20 and the motion mitigator 16. As described further below, in circumstances where movement of the operating plate 20 is impeded when the actuator 14 is operated, the motion mitigator 16 is configured to absorb, or mitigate movements of the drive arm 36 and may be placed into one or more loaded conditions to apply a biasing force or preload to the operating plate 20, through the actuator 14. However, with reference to the examples in FIGS. 1-3, when movement of the operating plate 20 is substantially unimpeded, and the operating plate 20 moves freely in response to operation of the actuator 14, the motion mitigator 16 remains substantially in a rigid or neutral condition.

FIGS. 1-3 show examples of a pin actuator assembly 10 in first, second and third conditions, respectively, when movement of the operating plate 20 is substantially unimpeded during operation of the actuator 14. Movement of the operating plate 20 may be unimpeded when the cylinder pin 22 and/or section lock arm 28 are free to move in response to operation of the actuator 14. Referring to FIG. 1, in the first condition, the actuator 14 and the operating plate 20 are each in a neutral position and the motion mitigator 16 is in its neutral condition. As shown in FIG. 1, in the first condition, the cylinder pin linkage 24 is positioned adjacent to the first guide wall 26 such that the cylinder pin 22 is in its extended pin position, and the section lock arm linkage 30 is positioned adjacent to the second guide wall 32 (FIG. 2) such that the section lock arm 28 is in the locking position.

Referring now to FIG. 2, in the second condition, the actuator 14 is operated to move from its neutral position to a retracted position by retracting the drive arm 36 with the motor 34. The operating plate 20 is moved from its neutral position to a retracted position in response to movement of the actuator 14 to the retracted position. The motion mitigator 16 remains in its rigid, neutral condition. Movement of the operating plate 20 from its neutral position to its retracted position causes the first guide wall 26 to move relative to the cylinder pin linkage 24 and displace the cylinder pin linkage 24 in a transverse direction, thereby retracting the cylinder pin 22 to the retracted pin position. Conversely, movement of the operating plate 20 from the retracted position to the neutral position causes the cylinder pin 22 to move from its retracted pin position (FIG. 2) to its extended pin position (FIG. 1). In one embodiment, the cylinder pin 22 is configured to move between the extended and retracted pin positions in a direction substantially transverse to a direction of movement of the operating plate 20. The section lock arm 28 remains in the locking position because movement of the second guide wall 32 with the operating plate 20 from the neutral position to the retracted position does not cause the section lock arm linkage 30 to move in the transverse direction. For example, the cylinder pin linkage 24 may be engaged with a section of the first guide wall 26 extending in a direction having a lateral component relative to the direction of movement of the operating plate 20, and the section lock arm linkage 30 may be engaged with a section of the second guide wall 32 extending in a direction that is substantially the same as a direction of movement of the operating plate 20.

Referring now to FIG. 3, in the third condition, the actuator 14 is operated to move from its neutral position to an extended position by extending the drive arm 36 with the motor 34. The operating plate 20 is moved from its neutral position to an extended position in response to movement of the actuator 14 to the extended position. The motion mitigator 16 remains in the rigid, neutral condition. Movement of the operating plate 20 from its neutral position to the extended position causes the first guide wall 26 to move relative to the cylinder pin linkage 24 but does not displace the cylinder pin linkage 24 in a transverse direction. Accordingly, the cylinder pin 22 remains in its extended pin position. However, movement of the operating plate 20 from its neutral position to its extended position causes the second guide wall 32 to move relative to the section lock arm linkage 30 to displace the section lock arm linkage 30 in the transverse direction, thereby moving the section lock arm 28 from the locking position (FIG. 1) to the unlocking position (FIG. 3). Conversely, movement of the operating plate 20 from the extended position to the neutral position causes the section lock arm 28 to move from the unlocking position to the locking position. For example, the cylinder pin linkage 24 may engage a section of the first guide wall 26 extending in a direction substantially the same as the direction of the movement of the operating plate 20, and the section lock arm linkage 30 may engage a section of the second guide wall 32 extending in a direction having a lateral component relative to the direction of movement of the operating plate 20.

Accordingly, the actuator 14 is configured for movement between its retracted position and its extended position with a neutral position therebetween. The operating plate 20 is also configured for movement between its retracted position and its extended position with a neutral position therebetween. With movement of the operating plate 20 substantially unimpeded, movements of the actuator 14 and the operating plate 20 substantially correspond to one another and the motion mitigator 16 remains in the rigid, neutral condition. In one embodiment, movements of the actuator 14 and operating plate 20 may be generally in line with one another in a first direction D1 (FIG. 3) and a second direction D2 (FIG. 2), opposite to the first direction D1.

Figure 4:
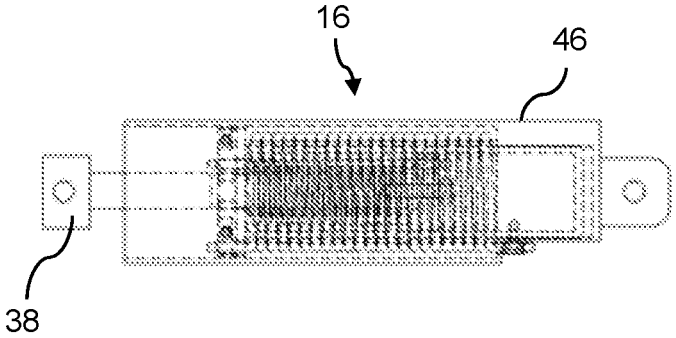
FIG. 4 is a side view of a motion mitigator according to an embodiment.
Figure 5:
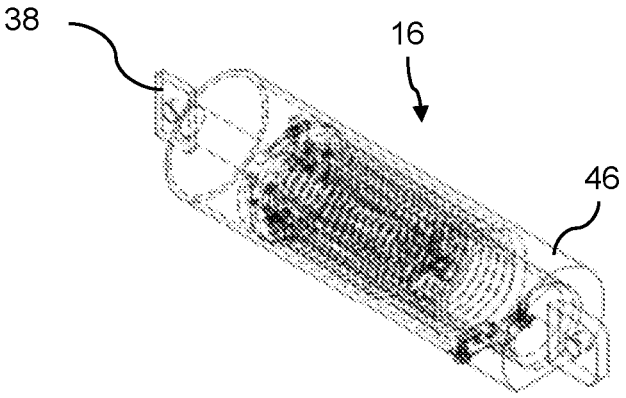
FIG. 5 is a perspective view of the motion mitigator of FIG. 4.
Figure 6:
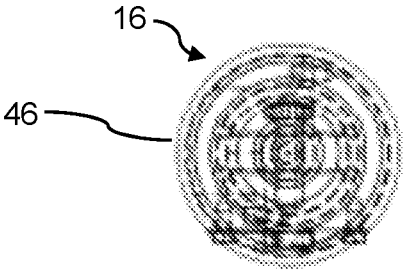
FIG. 6 is an end view of the motion mitigator of FIG. 4.
Figure 7:
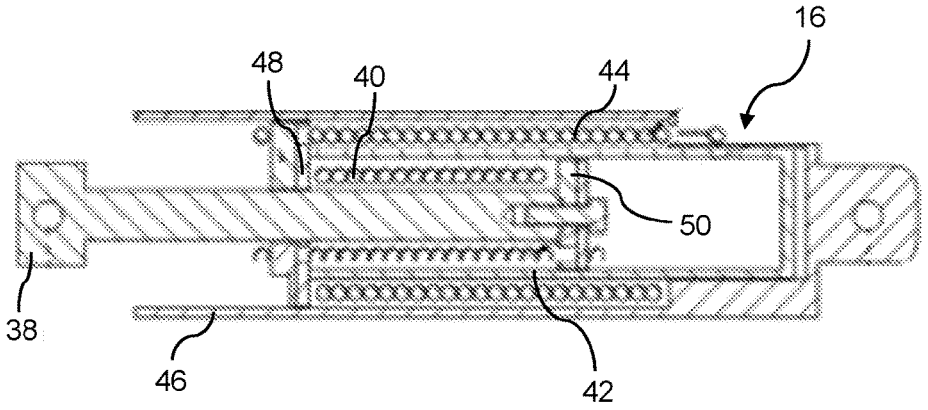
FIG. 7 is a side cross-sectional view of a motion mitigator in a neutral condition, according to an embodiment.
Figure 8:
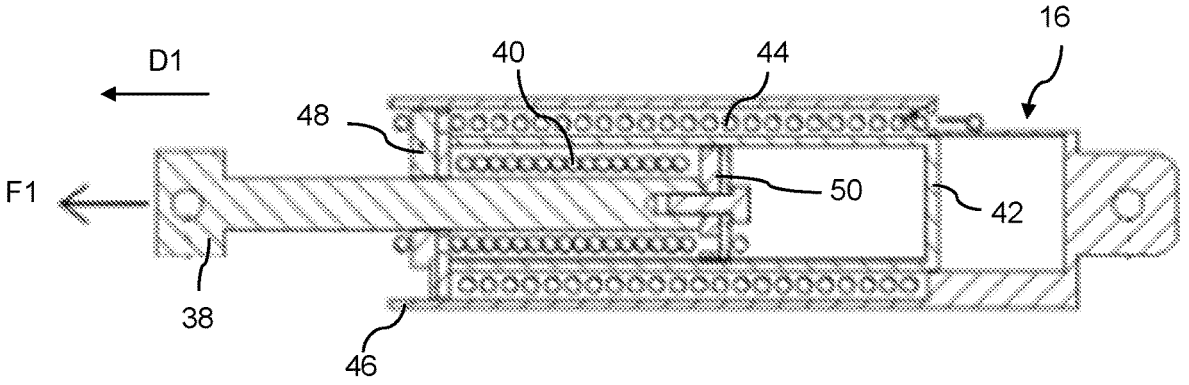
FIG. 8 is a side cross-sectional view of a motion mitigator in a first loaded condition, according to an embodiment.
Figure 9:
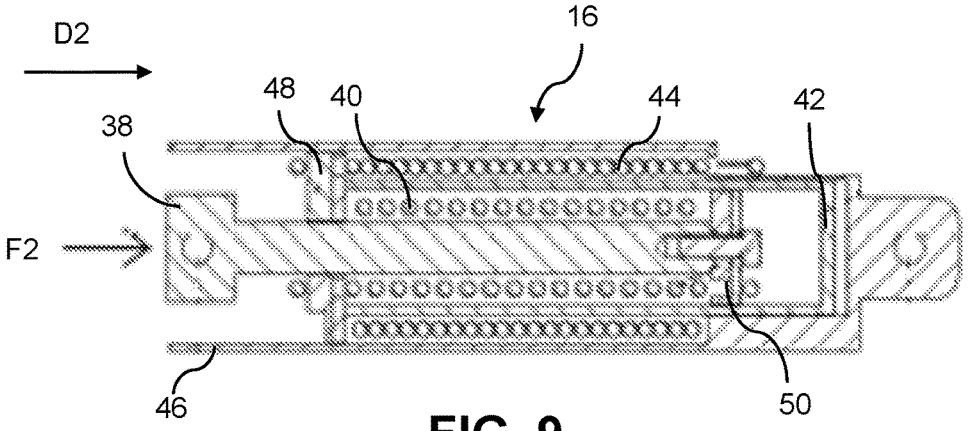
FIG. 9 is a side cross-sectional view of a motion mitigator in a second loaded condition, according to an embodiment.

FIGS. 4-6 show side, perspective and end views, respectively, of the motion mitigator 16, according to an embodiment described herein. FIG. 7 is a cross-sectional view showing the motion mitigator 16 in the rigid, neutral condition, and FIGS. 8 and 9 are cross-sectional views showing the motion mitigator 16 in first and second loaded conditions, respectively, according to embodiments described herein. Referring to FIGS. 4-9, the motion mitigator 16 generally includes a rod 38, a first biasing member, such as a spring 40, for applying a first biasing or spring force, a sleeve 42, a second biasing member, such as a spring 44, for applying a second biasing or spring force, and a housing 46. In one embodiment, the rod 38 is coupled to the drive arm 36. A slide plate 48 may be movably disposed on the rod 38 and serve as a seat for first ends of first and second springs 40, 44. A retainer plate 50 may be disposed at or near a free end of the rod 38 and serve as a seat for a second end of the first spring 40. A second end of the second spring 44 may be seated at a portion of the housing 46.

In one embodiment, the first and second springs 40, 44 are each movable between an initial, neutral position (FIG. 7), to an extended, loaded position (first spring 40 in FIG. 9, second spring 44 in FIG. 8). In one embodiment, the first spring 40 is disposed within at least a portion of the second spring 44. In addition, in one embodiment, the sleeve 42 is movable within the housing 46, and the rod 38 is configured for movement between a neutral position (FIG. 7) and an extended position (FIG. 8) and between the neutral position and a retracted position (FIG. 9).

In one embodiment, the first spring 40 and the second spring 44 may be tension springs which are extendable when a force applied thereon exceeds an initial tension of the spring. The initial tension of the first spring 40 may be different than the initial tension of the second spring 44. For example, as described further below, in some circumstances, movement of the operating plate 20 may be impeded. Such circumstances may occur, for example, when a cylinder pin 22, section locking pin and/or section lock arm 28 is not properly positioned relative to a boom section and movement of the pin 22, locking pin and/or lock arm 28 is impeded. Another such circumstance may occur when movement of a cylinder pin 22 or section locking pin is engaged with a boom section but becomes misaligned, resulting in a force on the cylinder pin 22, locking pin and/or section lock arm 28 which impedes movement. In embodiments below, because of an operable connection between the section locking pin and the section lock arm 28, impeded movement of the section locking pin may impede movement of the section lock arm 28, and that movement of the section lock arm 28 may cause movement of the section locking pin. Similarly, improper positioning of a section locking pin may cause improper positioning of a section lock arm 28, and vice versa.

In such circumstances, according to embodiments described herein, the actuator 14 may be operated to move from a current position to any other of its retracted, neutral or extended positions. However, the motion-impeded operating plate 20 may remain fixed in position during movement of the actuator 14. That is, the operating plate 20 may not move in response to movement of the actuator 14. Movement of the actuator 14 when the operating plate 20 is held against movement generates a reaction force that is applied to the motion mitigator 16 through the actuator 14. The reaction force may be applied, for example, to the rod 38 as a force in either the first direction D1 or the second direction D2 which may exceed the initial tension in the first spring 40 or second spring 44. Accordingly, the first or second spring 40, 44 may be extended and the rod 38 may be moved from its neutral position to an extended or retracted position.

With further reference to FIG. 7, the motion mitigator 16 is shown in the neutral condition, according to an embodiment. In the neutral condition, the rod 38 may be in its neutral position and the first and second springs 40, 44 may each be in their initial, neutral positions. In one embodiment, the first and second springs 40, 44 may be substantially unloaded in their initial, neutral positions. When movement of the operating plate 20 is substantially unimpeded, as described above in the examples of the first, second and third conditions, a reaction force generally does not exceed, or does not substantially exceed an initial tension of the springs 40, 44, and thus, the motion mitigator 16 remains in the neutral condition.

Referring to FIG. 8, the motion mitigator 16 may be placed in a first loaded condition when, for example, movement of the actuator 14 with an impeded operating plate 20 causes a first force F1 to be applied in the first direction D1 to the rod 38. The first force F1 may exceed the initial tension of the second spring 44, causing the rod 38 to move from its neutral position to its extended position and the second spring 44 to move from its initial, neutral position to its extended, loaded position. Thus, the rod 38 may be moved from its neutral position to its extended position against a spring force of the second spring 44. In the first loaded condition, the spring force of the second spring 44 is transmitted through the rod 38 and the actuator 14 and is applied to the operating plate 20 to urge the operating plate 20 to a position corresponding to the position of the actuator 14 when movement of the operating plate 20 is no longer impeded.

Referring to FIG. 9, the motion mitigator 16 may be placed in a second loaded condition when, for example, movement of the actuator 14 with an impeded operating plate 20 causes a second force F2 to be applied in the second direction D2 to the rod 38. The second force F2 may exceed the initial tension of the first spring 40, causing the rod 38 to move from its neutral position to its retracted position and the first spring 40 to move from its initial, neutral position to its extended, loaded position. That is, the rod 38 may be moved from its neutral position to its retracted position against a spring force of the first spring 40. In the second loaded condition, the spring force of the first spring 40 is transmitted through the rod 38 and the actuator 14 and is applied to the operating plate 20 to urge the operating plate 20 to a position corresponding to the position of the actuator 14 when movement of the operating plate 20 is no longer impeded.

FIGS. 10-13 show examples of the pin actuator assembly 10 in fourth, fifth, sixth and seventh conditions, respectively, when movement of the operating plate 20 is impeded, for example, by improper positioning of the cylinder pin 22 or section lock arm 28.

Figure 10:
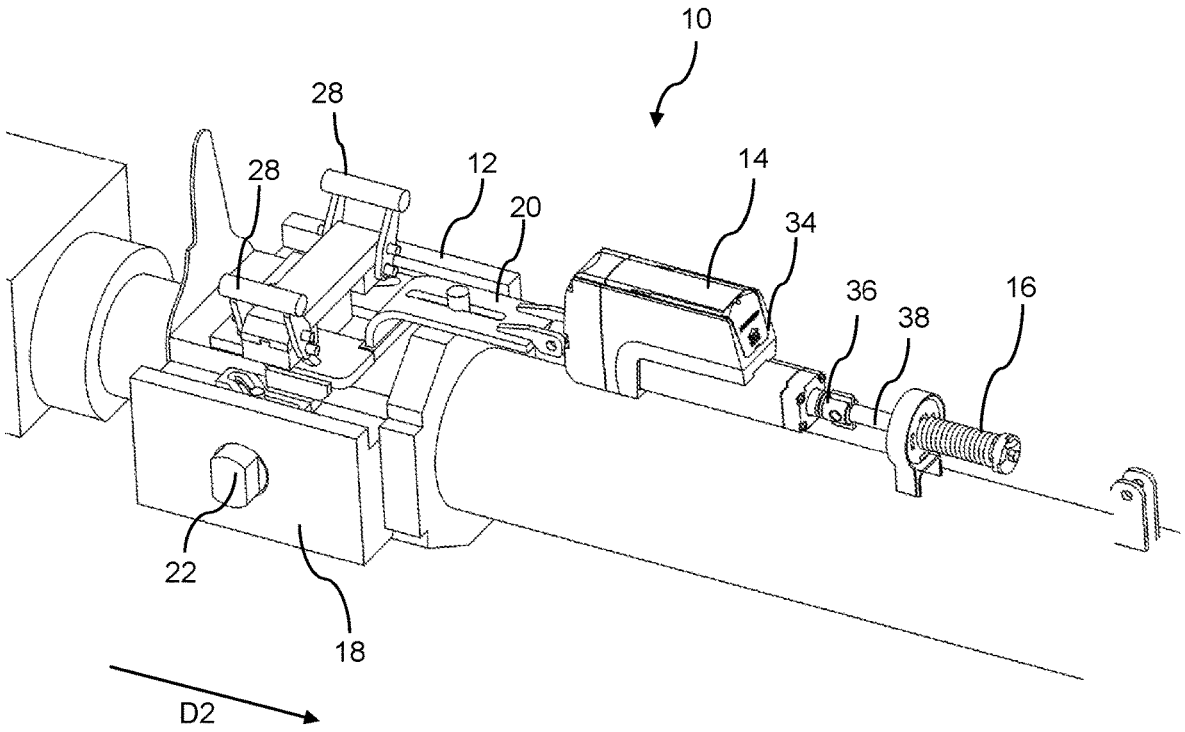
FIG. 10 is a perspective view of a pin actuator assembly in a fourth condition, according to an embodiment.

Referring to FIG. 10, in the fourth condition, the actuator 14 is operated to move to from its neutral position to its retracted position by retracting the drive arm 36. However, with movement of the operating plate 20 impeded, the operating plate 20 may remain in its neutral position. In this example, a reaction force is generated by the operating plate 20 which applies the first force F1 to motion mitigator 16 to place the motion mitigator 16 in the first loaded condition shown, for example, in FIG. 8. In the first loaded condition of the motion mitigator 16, the second spring 44 applies a spring force to the rod 38 urging the rod 38 to its neutral position and to the operating plate 20 urging the operating plate 20 to its retracted position, which corresponds to the position of the actuator 14. Thus, the spring force is applied to the rod 38 and operating plate 20 in the second direction D2.

Accordingly, upon positioning or re-positioning of the locking head 12, such that the movement of the pins 22 and/or section lock arms 28 and operating plate 20 are no longer impeded, the operating plate 20 may be moved to its retracted position under the spring force of the second spring 44, the rod 38 may be moved to its neutral position, and second spring 44 may return to its initial, neutral position. That is, the motion mitigator 16 may be placed in its neutral condition (FIG. 7) when movement of the operating plate 20 is no longer impeded. As a result, the pin actuator assembly 10 may be moved from the fourth condition shown in FIG. 10 to the second condition shown in FIG. 2.

Figure 11:
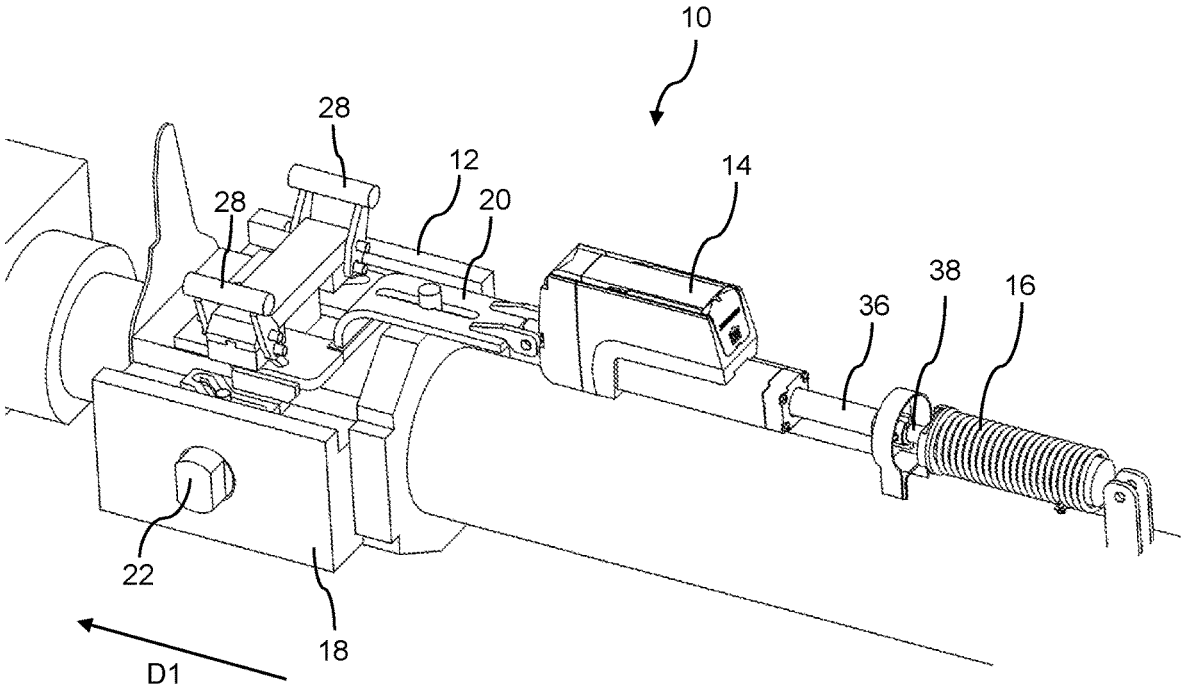
FIG. 11 is a perspective view of a pin actuator assembly in a fifth condition, according to an embodiment.
Figure 12:
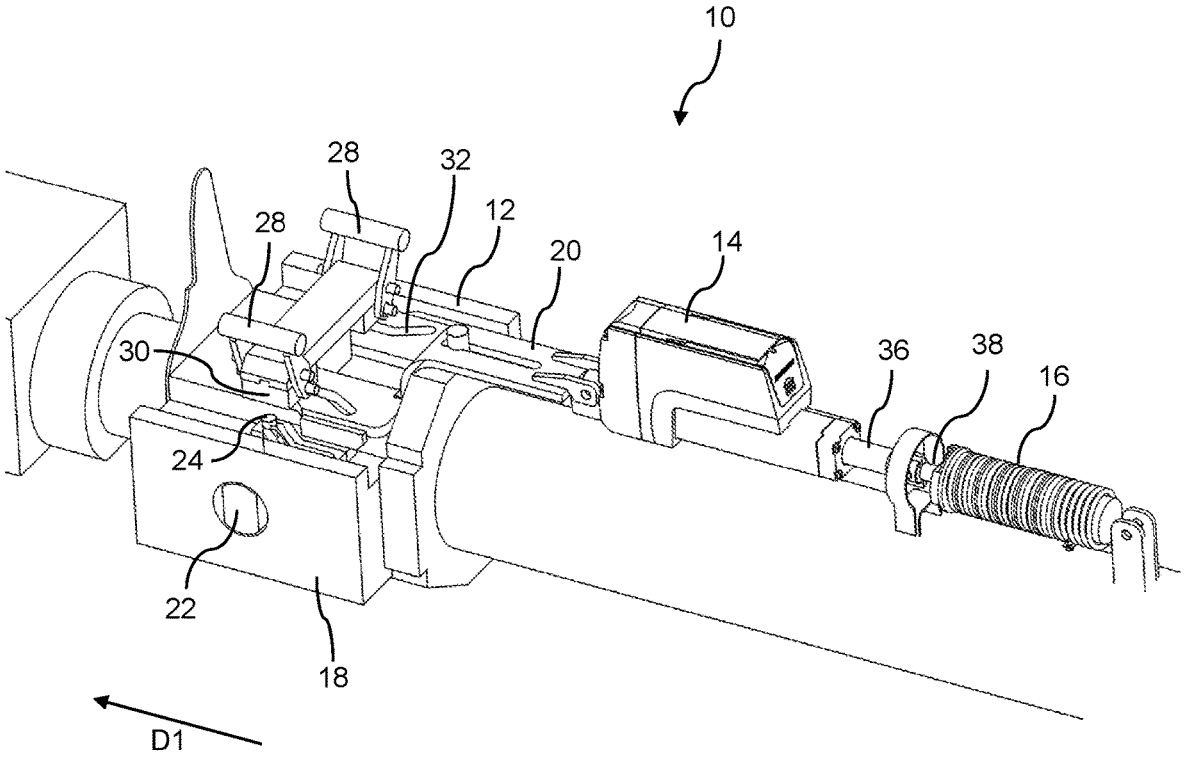
FIG. 12 is a perspective view of a pin actuator assembly in a sixth condition, according to an embodiment.

Referring to FIG. 11, in a fifth condition, the actuator 14 may be moved from its neutral position to its extended position by extending the drive arm 36. However, with movement of the operating plate 20 impeded, the operating plate 20 may remain in its neutral position. In this example, a reaction force is generated by the operating plate 20 which applies the second force F2 to motion mitigator 16 to place the motion mitigator 16 in the second loaded condition shown, for example, in FIG. 9. Accordingly, the first spring 40 is moved to its extended, loaded position and applies a spring force in the first direction D1 urging the rod 38 to its neutral position and the operating plate 20 to its extended position. Thus, when the locking head 12 is positioned such that movement of the pins 22 and/or lock arms 28 and the operating plate 20 are no longer impeded, the operating plate 20 may be moved to its extended position under the spring force of the first spring 40, and the motion mitigator 16 may be placed in its neutral condition (FIG. 7). That is, by way of the motion mitigator 16, the pin actuator assembly 10 may be moved from the fifth condition shown in FIG. 11 to the third condition shown in FIG. 3.

Movements of the operating plate 20 to its neutral position from either of its retracted or extended positions, in response to operation of the actuator 14, may be impeded by the cylinder pins 22 and/or section lock arm 28 as well. For example, referring to FIG. 12, in a sixth condition, the actuator 14 may be moved from its retracted position to its neutral position. However, with movement of the operating plate 20 impeded, the operating plate 20 may remain in its retracted position. In this example, a reaction force is generated which applies the second force F2 to the motion mitigator 16 to place the motion mitigator 16 in the second loaded condition (FIG. 9). Accordingly, the first spring 40 applies a spring force in the first direction D1 urging the rod 38 and the operating plate 20 to their respective neutral positions. Thus, when movement of the operating plate 20 is no longer impeded, the operating plate 20 may be moved to its neutral position under the spring force of the first spring 40 and the motion mitigator 16 may return to its neutral condition (FIG. 7). That is, by way of the motion mitigator 16, the pin actuator assembly 10 may be moved from the sixth condition shown in FIG. 12 to the first condition shown in FIG. 1.

Figure 13:
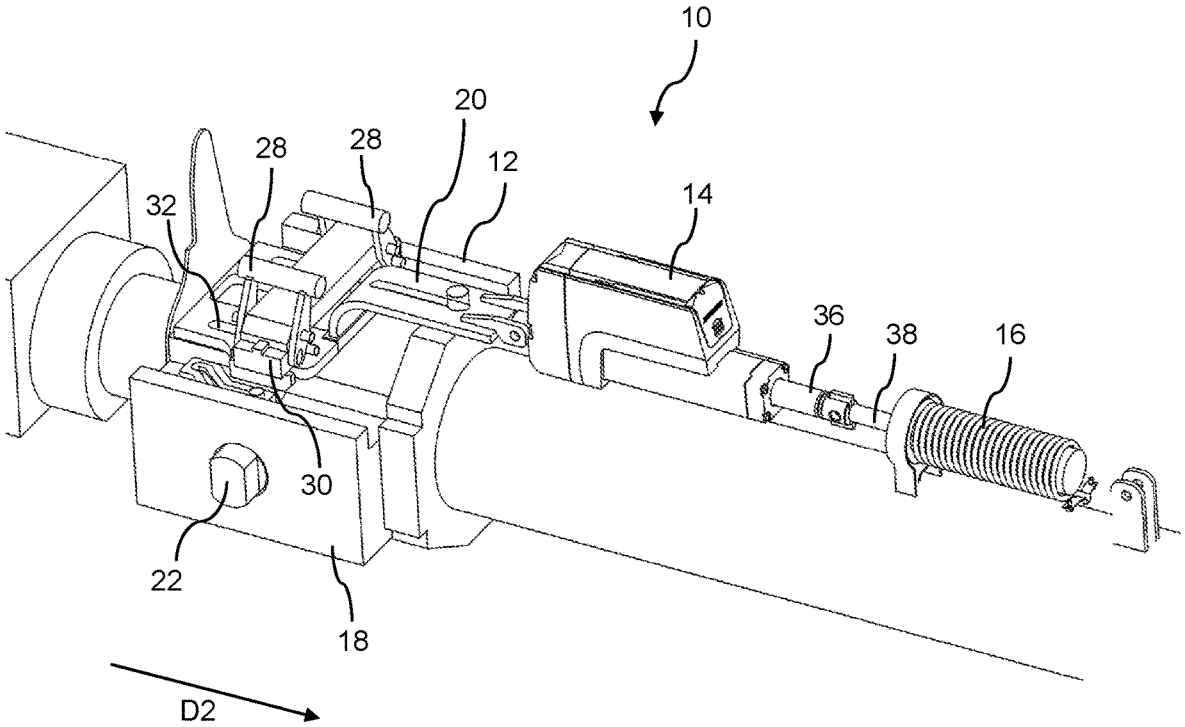
FIG. 13 is a perspective view of a pin actuator assembly in a seventh condition, according to an embodiment.

Referring to FIG. 13, in the seventh condition, the actuator 14 may be moved from its extended position to its neutral position. However, with movement of the operating plate 20 impeded, the operating plate 20 may remain in its extended position. In this example, a reaction force is generated which applies the first force F1 to the motion mitigator 16 to place the motion mitigator 16 in the first loaded condition (FIG. 8). Accordingly, the second spring 44 applies a spring force in the second direction D2 urging the rod 38 and the operating plate 20 to their respective neutral positions. Thus, when movement of the operating plate 20 is no longer impeded, the operating plate 20 may be moved to its neutral position under the spring force of the second spring 44 and the motion mitigator 16 may be placed in its neutral condition (FIG. 7). That is, by way of the motion mitigator 16, the pin actuator assembly 10 may be moved from the seventh condition shown in FIG. 13 to the first condition shown in FIG. 1.

In the embodiments above, the motion mitigator 16 is configured to mitigate movements of the actuator 14 when corresponding movements of the operating plate are impeded, for example, in circumstances where the cylinder pins 22 or section lock arm 28 are not properly positioned relative to the telescoping section of the boom. The motion mitigator 16, via the first or second spring 40, 44, is further configured to apply a spring force to the operating plate 20 urging the operating plate 20 to a position corresponding to the position to the actuator 14. Such movement of the operating plate 20 also causes intended movements of the cylinder pin 22 and/or section lock arms 28. Accordingly, the operating plate 20 and cylinder pin 22 and/or section lock arm 28 may be moved to their correct, or intended positions, without further operation of the actuator 14. As such, operations of the actuator 14, including the electric motor 34, may be reduced because the actuator 14 may only be operated once for each desired pinning operation, regardless of whether the cylinder pins 22 and/or section lock arm 28 are impeding movement of the operating plate 20. Thus, by way of the motion mitigator 16, movements of the actuator 14, including the drive arm 36, may be carried out even if movement of the operating plate 20 is impeded, which may reduce resistance on the actuator 14, improve operating life and decrease maintenance and replacement time and costs.

Figure 14:
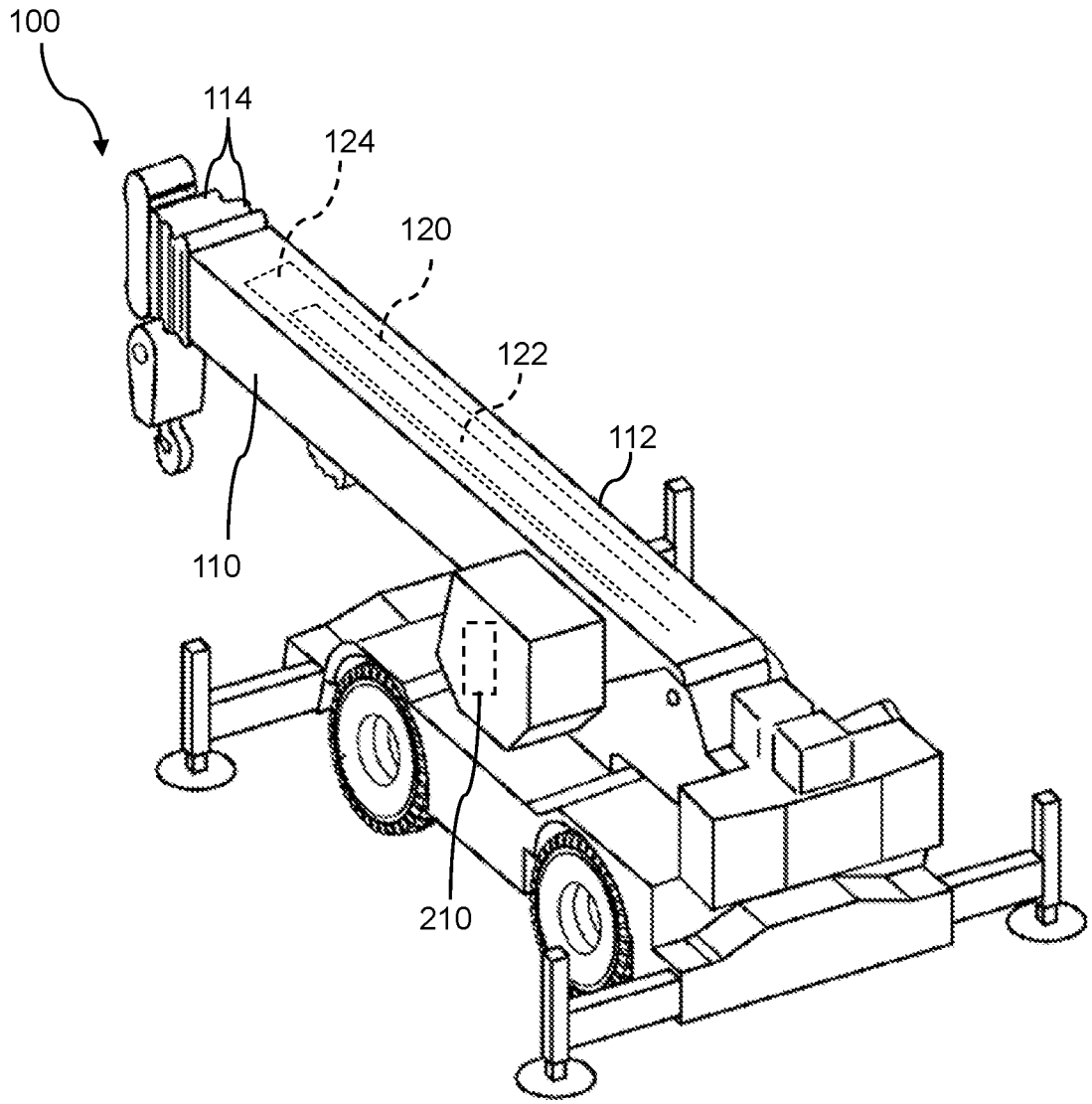
FIG. 14 is a perspective view of a crane having a telescoping boom, according to an embodiment.

FIG. 14 is a perspective view of a crane 100 having a telescoping boom 110 comprising a base section 112 and a plurality of telescoping sections 114 movable to extend and retract relative to the base section 112. The telescoping boom 110 may include a boom actuator 120, such a linear boom actuator comprising a telescoping rod 122 and a cylinder 124. With reference to FIGS. 1 and 14, in one embodiment, the pin actuator assembly 10 may be mounted on the boom actuator 120. For example, in one embodiment, the locking head 12 may be disposed at or near an end of the cylinder 124 and the motion mitigator 16 may be mounted at a position along a length of the cylinder 124. The crane 100 may also include a control system 210 operably connected to the boom actuator 120 and configured to control movements of the boom actuator 120 to extend and retract the telescoping sections 114. The control system 210 may also be operably connected to the pin actuator assembly 10, for example, to control operations of the actuator 14. In one embodiment, the control system 210 may control the boom actuator 120 to position or re-position the locking head 12 such that, or until, movement of the cylinder pins 22 and/or section lock arms 28 is not impeded. The control system 210 may include a computer configured to control operations of the boom actuator 120 and/or the pin actuator assembly 10.

It is understood that various features from any of the embodiments above are usable together with the other embodiments described herein.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. In addition, it is understood that terminology referring to orientation of various components, such as "upper" or "lower" is used for the purposes of example only, and does not limit the subject matter of the present disclosure to a particular orientation.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A pin actuator assembly for a telescoping boom, the pin actuator assembly comprising:

a locking head comprising a base, an operating plate operably coupled to the base, one or more cylinder pins and/or one or more section lock arms movable in response to movement of the operating plate relative to the base;

an actuator operably coupled to the operating plate and configured to move the operating plate relative to the base, the actuator comprising an electric motor and a drive arm, wherein the electric motor is configured to drive the drive arm between an extended drive arm position and a retracted drive arm position; and a motion mitigator comprising a housing, a rod movable relative to the housing and operably coupled to the actuator, a first biasing member coupled between the rod and the housing and a second biasing member coupled between the rod and the housing, wherein the motion mitigator is configured to absorb movements of the drive arm and apply a biasing force to the operating plate when movement of the operating plate is impeded.

2. The pin actuator assembly of claim 1, wherein the one or more cylinder pins are movable between a retracted pin position and an extended pin position in response to movement of the operating plate relative to the base; and the one or more section lock arms are movable between a locking position and an unlocking position in response to movement of the operating plate relative to the base.

3. The pin actuator assembly of claim 1, wherein movement of the drive arm from a neutral drive arm position to the retracted drive arm position causes a first force to be applied to the motion mitigator and movement of the drive arm from the neutral drive arm position to the extended drive arm position causes a second force to be applied to the motion mitigator.

4. The pin actuator assembly of claim 3, wherein the first biasing member is a first spring and the second biasing member is a second spring.

5. A telescoping boom for a crane, the telescoping boom comprising:

a base section;

a plurality of telescoping sections movable relative to the base section to adjust a length of the boom;

a boom actuator disposed within the base section operable to move a telescoping section of the plurality of telescoping sections to adjust the length of the boom; and a pin actuator assembly operably connected to the boom actuator, the pin actuator assembly comprising:

a locking head comprising a base, an operating plate operably coupled to the base, one or more cylinder pins and/or one or more section lock arms movable to selectively engage a telescoping section of the plurality of telescoping sections in response to movement of the operating plate relative to the base;

a pin actuator operably coupled to the operating plate and configured to move the operating plate relative to the base, the pin actuator comprising an electric motor and a drive arm, wherein the electric motor is configured to drive the drive arm between an extended drive arm position and a retracted drive arm position; and a motion mitigator comprising a housing, a rod movable relative to the housing and operably coupled to the actuator, a first spring coupled between the rod and the housing and a second spring coupled between the rod and the housing, wherein the motion mitigator is configured to absorb movement of the drive arm and apply a biasing force to the operating plate when movement of the operating plate is impeded.

6. The telescoping boom of claim 5, wherein the one or more cylinder pins are movable between a retracted pin position disengaged from a telescoping section of the plurality of telescoping sections and an extended pin position engaged with a telescoping section of the plurality of telescoping sections; and the one or more section lock arms are movable between a locking position to lock a section locking pin on a telescoping section of the plurality of telescoping sections and an unlocking position to unlock the section locking pin on a telescoping section of the plurality of telescoping sections.

7. The telescoping boom of claim 5, wherein movement of the drive arm from a neutral drive arm position to the retracted drive arm position causes a first force to be applied to the motion mitigator and movement of the drive arm from the neutral drive arm position to the extended drive arm position causes a second force to be applied to the motion mitigator.

8. The telescoping boom of claim 7, wherein when the first force exceeds an initial tension of the second spring, the motion mitigator is moved from a neutral condition to a first loaded condition in which the second spring applies a spring force to the operating plate in one direction; and wherein when the second force exceeds an initial tension of the first spring, the motion mitigator is moved from the neutral condition to a second loaded condition in which the first spring applies a spring force to the operating plate in another direction opposite to the one direction.

9. The telescoping boom of claim 8, wherein the first force moves the rod against the spring force of the second spring when the motion mitigator is moved from the neutral condition to the first loaded condition, and wherein the second force moves the rod against the spring force of the first spring when the motion mitigator is moved from the neutral condition to the second loaded condition.

10. A pin actuator assembly for a telescoping boom, the pin actuator assembly comprising:

a locking head comprising a base, an operating plate operably coupled to the base, one or more cylinder pins and/or one or more section lock arms movable in response to movement of the operating plate relative to the base;

an actuator operably coupled to the operating plate and configured to move the operating plate relative to the base, the actuator comprising an electric motor and a drive arm, wherein the electric motor is configured to drive the drive arm between an extended drive arm position and a retracted drive arm position; and a motion mitigator comprising a housing, a rod movable relative to the housing and operably coupled to the actuator, a first biasing member coupled between the rod and the housing and a second biasing member coupled between the rod and the housing, wherein movement of the drive arm from a neutral drive arm position to the retracted drive arm position causes a first force to be applied to the motion mitigator and movement of the drive arm from the neutral drive arm position to the extended drive arm position causes a second force to be applied to the motion mitigator, wherein the first biasing member is a first spring and the second biasing member is a second spring, and wherein when the first force exceeds an initial tension of the second spring, the motion mitigator is moved from a neutral condition to a first loaded condition in which the second spring applies a spring force to the operating plate in one direction; and wherein when the second force exceeds an initial tension of the first spring, the motion mitigator is moved from the neutral condition to a second loaded condition in which the first spring applies a spring force to the operating plate in another direction opposite to the one direction.

11. The pin actuator assembly of claim 10, wherein the first force moves the rod against the spring force of the second spring when the motion mitigator is moved from the neutral condition to the first loaded condition, and wherein the second force moves the rod against the spring force of the first spring when the motion mitigator is moved from the neutral condition to the second loaded condition.

* * * * *